US005400719A

United States Patent [19]

Santapa et al.

[11] Patent Number: 5,400,719

[45] Date of Patent: Mar. 28, 1995

[54] MODULAR ASSEMBLY AND COMPONENTS THEREFOR

[75] Inventors: Frank J. Santapa, Rosemont; Raul Munoz, Chicago, both of Ill.

[73] Assignee: Selfix, Inc., Chicago, Ill.

[21] Appl. No.: 131,779

[22] Filed: Oct. 4, 1993

[51] Int. Cl.[6] ..... A47B 57/00

[52] U.S. Cl. ..... 108/64; 108/91; 108/182

[58] Field of Search ..... 108/64, 180, 182, 185, 108/190, 91, 92, 96, 101

[56] References Cited

U.S. PATENT DOCUMENTS

| | | | |
|---|---|---|---|
| 3,831,533 | 8/1974 | Kellogg | 108/101 X |
| 4,275,666 | 6/1981 | Schriever | 108/101 |
| 4,467,927 | 8/1984 | Nathan | 108/91 X |
| 4,836,393 | 6/1989 | Maye | 108/91 X |
| 5,158,187 | 10/1992 | Taub | 108/190 X |
| 5,218,914 | 6/1993 | Dickinson | 108/64 |

FOREIGN PATENT DOCUMENTS

| | | | |
|---|---|---|---|
| 2513622 | 10/1975 | Germany | 108/190 |
| 3629129 | 3/1988 | Germany | 108/91 |
| 459999 | 10/1950 | Italy | 108/91 |

*Primary Examiner*—José V. Chen

*Attorney, Agent, or Firm*—Dressler Goldsmith Shore & Milnamow, Ltd.

[57] ABSTRACT

A modular assembly comprised of a plurality of shelf members, each having a plurality of equally spaced sockets for selectively receiving a plurality of legs insertable therein to facilitate a variety of arrangements of interconnected shelf members. Cap members can be inserted into said sockets to provide a smooth surface.

13 Claims, 3 Drawing Sheets

MODULAR ASSEMBLY AND COMPONENTS THEREFOR

FIELD OF THE INVENTION

This invention relates to a modular assembly useful as a storage unit or work surface and components therefor, and more particularly to such modular assemblies having the capability of being assembled in a variety of configurations.

BACKGROUND OF THE INVENTION

Modular assemblies such as modular storage shelves or work tops such as desks and tables are widely known, and have taken a number of configurations. For example, storage shelves exist in which one or more generally planar shelf members are supported one on the other by legs connected to the shelves at or adjacent to the corners thereof. The legs or stanchions are connected to the shelves in various configurations, e.g., utilizing additional connecting elements, recesses or projections located at the corners for insertion into or for receiving the legs. Desks and table tops may be similarly constructed.

In particular, components useful and designed for use by children can be made in such a fashion in a variety of materials. Typically, such products may be molded from a suitable plastic material and can be sold in a "knock-down" configuration for assembly by the user. Components of such assemblies are often stacked one above the other and are aligned with each other as is typical for arrangements of shelves. In some arrangements, shelves that can be arranged side by side at different levels by aligning their peripheral edges and connecting the aligned peripheral edges by legs located at the corners thereof.

It would be desirable particularly in such assemblies designed for and utilized by young children to provide a modular assembly having a capability of being arranged in a variety if different configurations to accommodate the changing tastes of children, to facilitate changes in such arrangements in order to encourage the use by children and to be able to do so while attempting to minimize costs by minimizing the number of different components.

SUMMARY OF THE INVENTION

In accordance with the present invention, there is provided a modular assembly and components therefor which are capable of being interconnected to produce a variety of stacked arrangements having different configurations. The components of a modular assembly incorporating the present invention may be oriented at different angles with respect to each other, and may be connected at different relative positions one to the other all while minimizing the number of different components required for such assemblies.

More specifically, an assembly incorporating the present invention utilizes a shelf or work surface member or unit supported at selected locations by a plurality of stanchions or leg members connected thereto. A shelf or work surface member in accordance with the present invention typically includes a plurality of locations for receiving stanchions or leg members with each of the locations being equally spaced from the closest adjacent locations.

A shelf or work surface unit in accordance with one aspect of the present invention incorporates a generally planar work surface and is provided with a plurality of sockets formed at spaced locations in the surface thereof having the capability of receiving legs or stanchions inserted therein from both sides thereof to allow a plurality of such work surface units to be stacked one on the other. Each such work surface unit includes a plurality of such sockets equally spaced from the closest adjacent sockets to permit interconnection and stacking of the shelf or work surface units in various configurations. While the work surface units incorporating the present invention can be used and configured for various purposes, they will be described for convenience as shelf units with the understanding that they are not limited to use as shelves or storage assemblies.

Typically, shelf units incorporating the present invention are rectangular in plan view and have dimensions equal to an integral multiple of the distances between adjacent leg connection locations, e.g., sockets. In this regard, a plurality of shelf units can be connected together by utilizing legs or stanchions connected thereto, e.g., inserted into sockets formed therein, from the bottom of one and the top of another. The provision of a plurality of equally spaced leg connection locations as a part of the shelf unit incorporating the present invention, permits a pair of legs or stanchions inserted into a pair of adjacent sockets in one shelf unit to be inserted into any pair of adjacent sockets in the another like shelf unit.

In this way, a variety of arrangements of components can be created having different shapes and interconnection patterns. The capability of creating such various arrangements permits the creation not only of assemblies forming stacked arrays of shelving with the shelf units aligned and stacked one above the other, but other arrangements in which the units can be arranged in non-aligned arrangements with shelf units connected to each other at various different positions.

In accordance with another aspect of the present invention, each of the shelf units is provided with a plurality of leg or stanchion receiving sockets passing therethrough at each of the connection locations. Each socket defines top and bottom recesses therein separated by a stop member formed intermediate the ends of the socket. The stop member formed intermediate the ends of the socket acts as an abutment for the end of a stanchion or leg inserted into the top or bottom recess.

Each leg or stanchion typically has the same cross-sectional configuration as the socket into which it is inserted and fits snugly therein to provide support for the shelf unit. The socket and stanchions may be circular in cross-section to provide the greatest flexibility.

In order to enhance the appearance and utility of the components and assembly incorporating the present invention, each of the sockets exposed to the upper or working surface of each shelf unit can be closed by a cap insertable therein. In accordance with an aspect of the present invention, the cap may have an enlarged upper portion which closely fits within the top recess of each socket and a somewhat smaller lower portion which extends down and engages the abutment formed in the socket. The height of the cap may correspond to the depth of the top recess, i.e., the distance between the abutment and the top surface of the shelf unit so that the exposed surface of the cap, when inserted into the top recess, is flush with the top surface of the shelf or work surface unit.

By virtue of providing a generally hollow socket passing through the shelf unit at each of the connection locations, a cap can be readily removed from the bottom by an object inserted into the bottom recess of a socket to push the cap free from the top recess to expose the socket for use and ready reception of a stanchion or leg inserted therein.

Numerous other advantages and features of the present invention will become readily apparent from the following detailed description of the invention and the embodiments thereof, from the claims, and from the accompanying drawings in which the details of the invention are fully and completely disclosed as a part of this specification.

DETAILED DESCRIPTION

Figure 1:
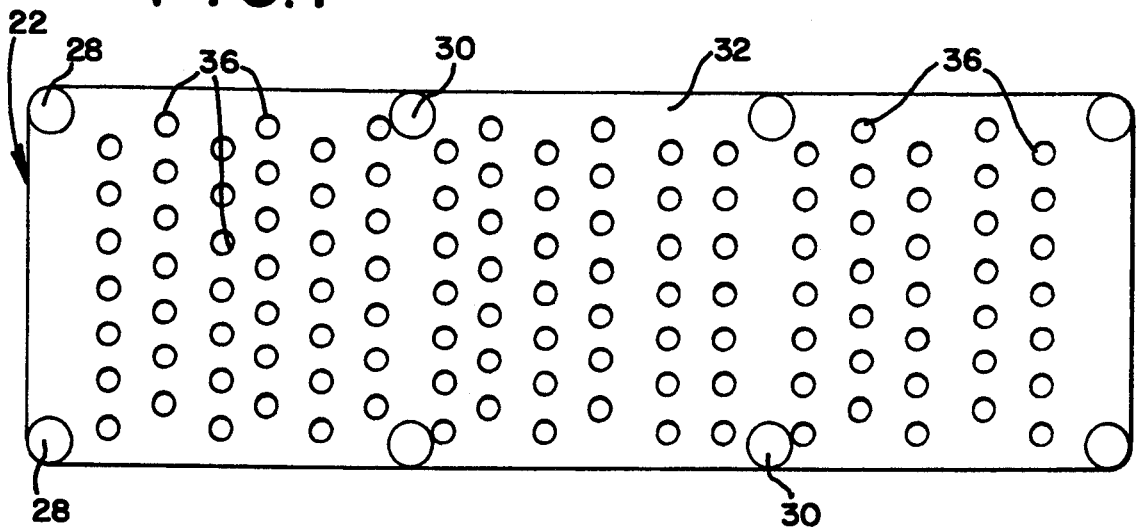
FIG. 1 is a plan view of a shelf unit component forming part of the modular assembly incorporating the present invention.

While this invention is susceptible of embodiment in many different forms, there is shown in the drawing and will be described herein in detail specific embodiments thereof with the understanding that the present disclosure is to be considered as an exemplification of the principles of the invention and is not intended to limit the invention to the specific embodiment illustrated.

An assembly 20 incorporating the present invention is comprised of two principal components, a shelf unit 22 which can act not only as a shelf or supporting member but also as a desk or a work space member, depending upon its position and arrangement, and a plurality of leg members or stanchions 24. In addition, cap members 26 can be provided, each insertable in a plurality of sockets 28, 30 formed in each of the shelf units 22.

As indicated above, although they can be used for a variety of purposes and have myriad applications, each of the generally planar units 22 will be identified as a shelf units for convenience.

Referring to FIG. 1, a shelf unit 22 incorporating the present invention incorporates a generally planar surface 32 having a sidewall 34 depending therefrom. Appropriate strengthening ribs can also be provided as appropriate. The shelf member 22 can be manufactured in a variety of ways including, for example, being injection molded from an appropriate materials such as a polymeric material, for example, styrene or polypropylene. As is known, in order to save material and weight, the surface of the shelf unit can be formed with a plurality of apertures 36 which not only saves material be also can be configured to provide a decorative effect.

Each of the shelf units 22 is provided with a plurality of corner sockets 28 and intermediate sockets 30 disposed around the peripheral edges thereof. Each of the sockets 28, 30 extends through the shelf unit 22 from top to bottom and is provided intermediate the ends thereof with a stop member 40, 42 which separates the socket into top and bottom recesses (**28*a*, 28*b* and 30*a*, 30*b*, respectively). The top and bottom recesses may be equal or may have different depths as shown. Each of the sockets 28, 30 is equally spaced from the closet adjacent sockets formed in the shelf unit 22**.

Figure 4:
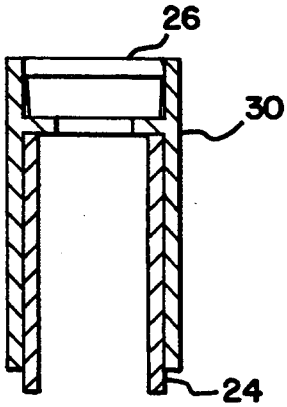
FIG. 4 is an enlarged view, partially in section showing the placement of a cap component in the work surface component in accordance with the present invention.
Figure 3:
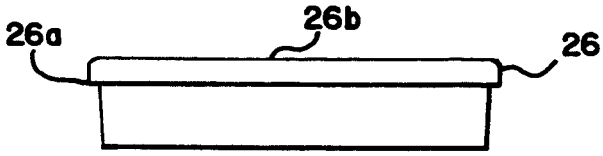
FIG. 3 is an elevational view of a cap component in accordance with the present invention.
Figure 5:
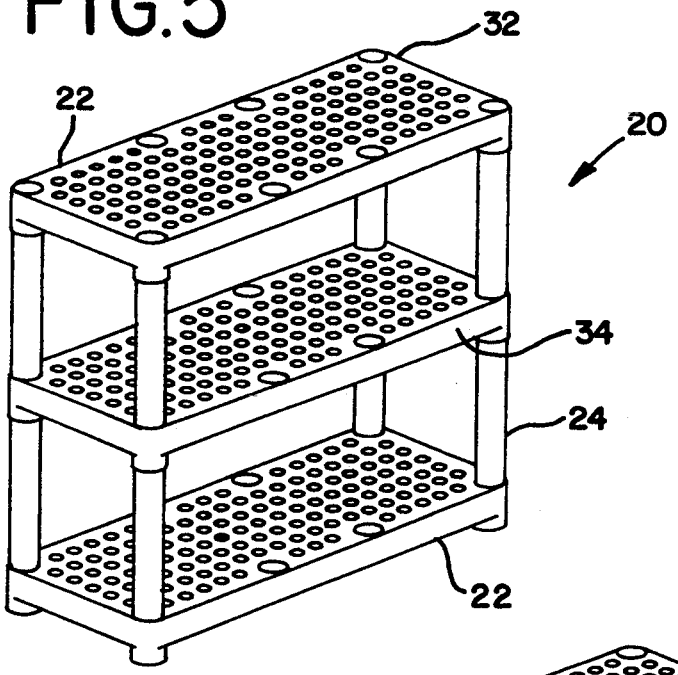
FIGS. 5–9 are perspective views of various arrangements of assemblies in accordance with the present invention.

In order to provide a relatively smooth surface, a cap member 26 is insertable into the upper recess **28*a*, 30*a* of each socket. The cap member 26 has an enlarged top portion 26*a* which has an outer dimension substantially equal but slightly less than the inner diameter of the sockets 28, 30 and is insertable therein as shown in FIG. 4**.

Figure 2:
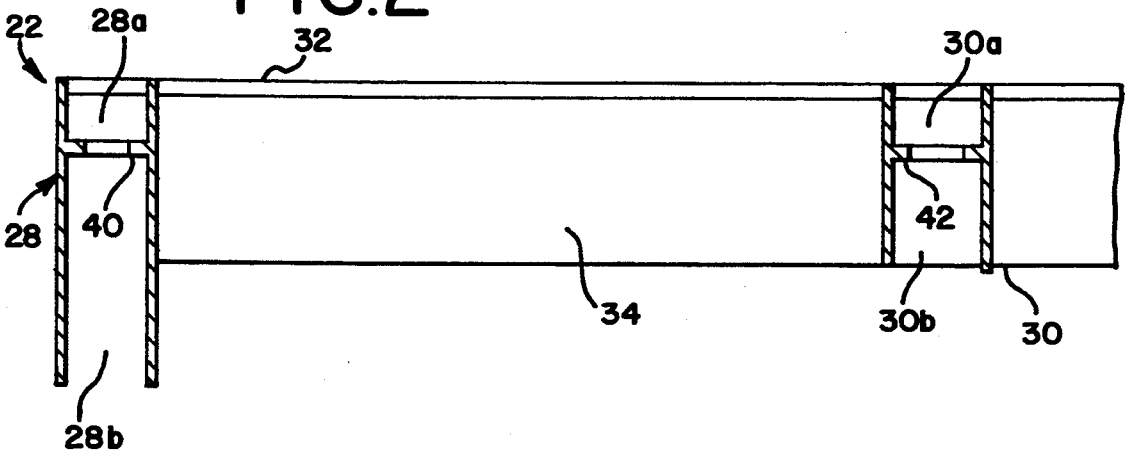
FIG. 2 is a side elevational view thereof, partially in section.

When inserted into the upper recess **28*a*, 30*a* of a socket 28, 30 with the bottom of the cap member 26 resting on the stop member 40, 42, the upper surface 26*b* of the cap member 26 is generally coplanar with the surface 32 of the shelf member 22. The sockets have different lengths as shown in FIG. 2. Typically, the corner sockets 28 may be longer than the intermediate sockets 30 to act as feet for the shelf unit 22 when resting on a surface, e.g., the floor. As shown in the drawings, the intermediate sockets 30 have a length equal to the depth of the sidewall 34, whereas the corner sockets 28** are longer.

The sockets 28, 30 shown in the drawing are generally circular in cross-section. Each is adapted to receive a cylindrical leg member 24 insertable therein. Each of the leg members 24 has an outer diameter generally corresponding to and slightly less than the inner diameter of the socket and are snugly receivable therein to provide a tight fit therebetween. The end of each leg member engages the stop member 40, 42 to provide a support for the shelf member 22 when the legs 32 are inserted into the bottom recess **28*b*, 30*b* or to provide a support for the leg member 24 extending up from a shelf member 22 when leg members are inserted into the top recess 28*a*, 30*a*. In order to remove the generally flush cap members 26, an object can be inserted through the bottom of the sockets 28, 30** to engage the cap member and eject it from the top recess when desired.

An assembly of shelf members incorporated in the present invention can take a variety of configurations as shown in FIGS. 5–9. For example, in FIG. 5, a standard shelf arrangement is shown in which each of the shelf members 22 is stacked one above the other and aligned with each other with leg members 24 insertable into the top recess of the four corner sockets in the bottom-most shelf member into the top and bottom recesses of the corner sockets of the middle shelf member and into the bottom recesses of the corner sockets of the top shelf member.

Figure 6:
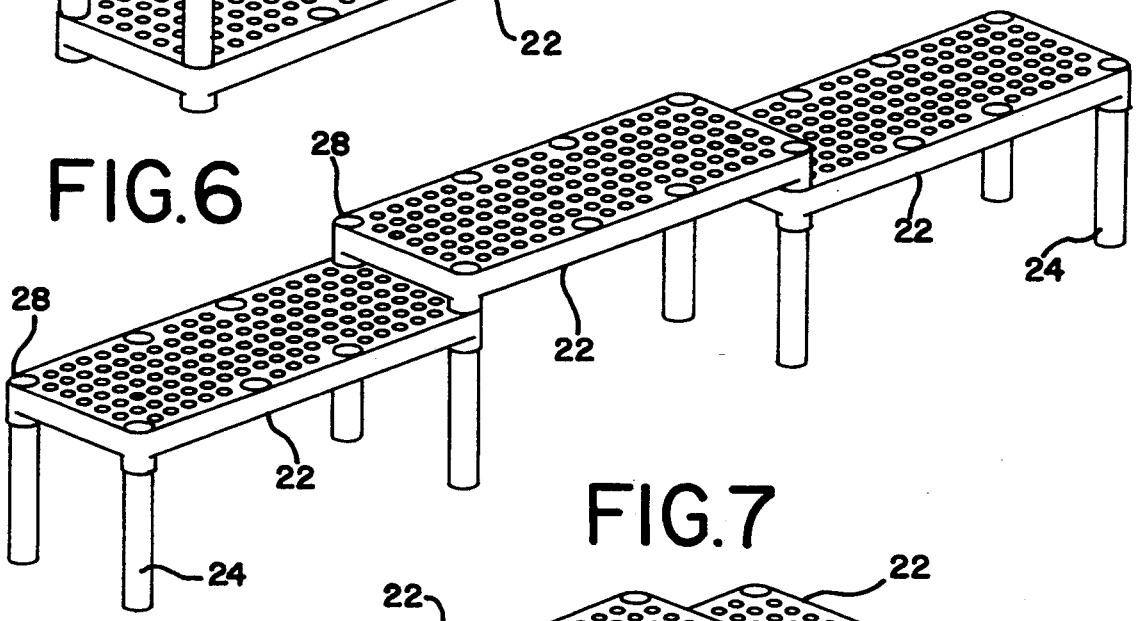

FIG. 6 shows an arrangement of shelf members connected end to end with the intermediate shelf member disposed above the outer shelf members. In this embodiment, a short leg member (not shown) may be used. Such a short leg member fits within the top and bottom recesses of the corner sockets and allow the shelf members to rest on each other.

Figure 7:
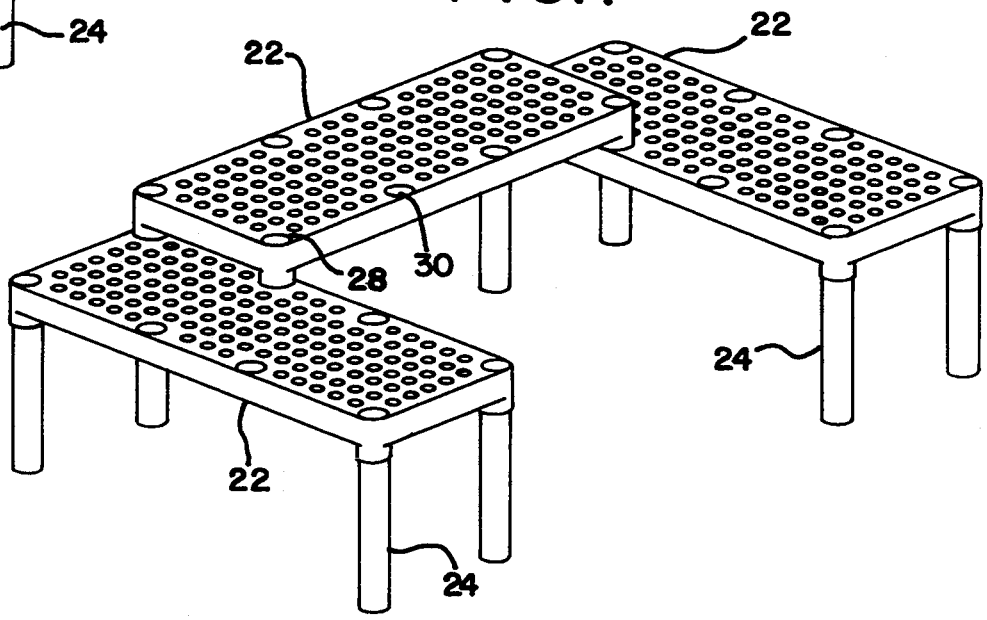

FIG. 7 shows a U-shaped arrangement of three shelf members 22 in which the center shelf member is connected between and is oriented transverse to the outer shelf members. The corner sockets 28 of the center short member are located above and connected to one corner socket 28 and one of the intermediate sockets 30 of each of the two outer members.

Figure 8:
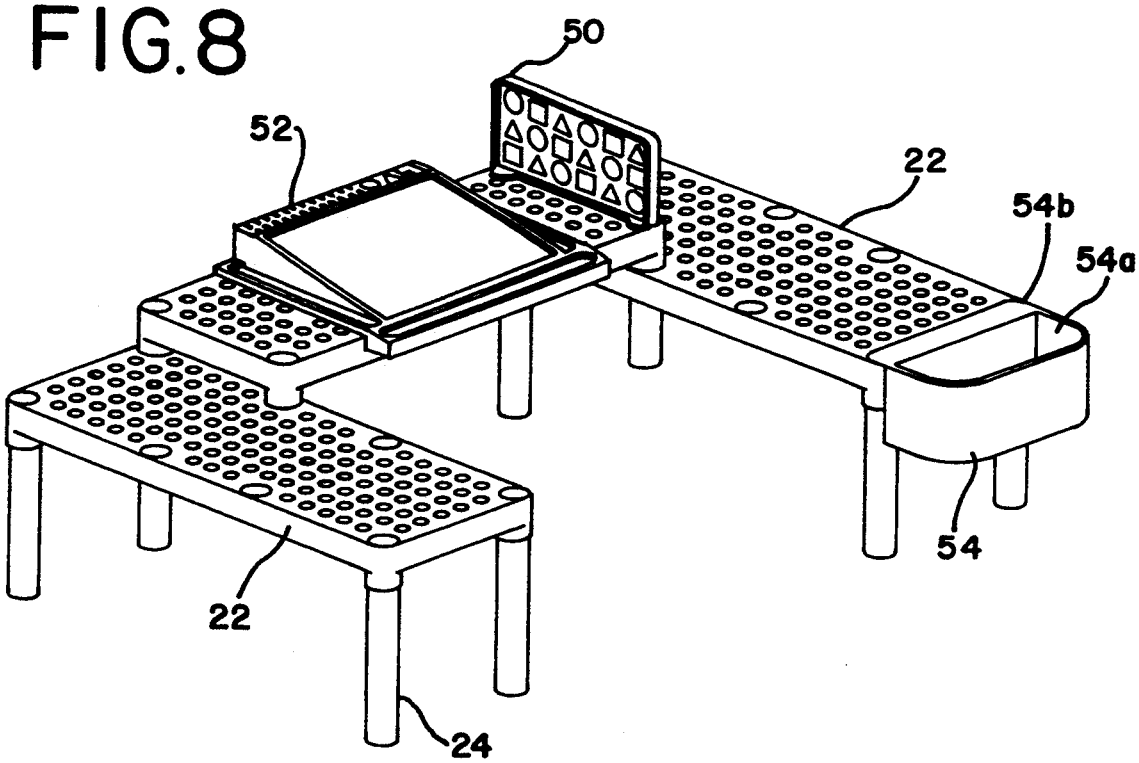

In FIG. 8, a U-shaped arrangement similar to FIG. 7 is shown in which additional components capable of interacting with the assembly incorporated with the present invention are depicted. Such components may take a form of a variety of accessories particularly useful with small children. As shown, one of the shaped members 50 is insertable into the upper recess 38*a* of one pair of the corner sockets 38. A work table member 52 is located in the center of one of the shelf members 22 and can be supported by projections extending into the apertures 36 formed in the surface thereof.

In addition, an adjunct container 54 can be supported such as shown in FIG. 8 having a container portion 54*a* and a flange 54*b*. The flange 54*b* may be formed with projections corresponding in size to the legs and insertable into the upper recesses of the corner sockets 38 as shown.

Figure 9:
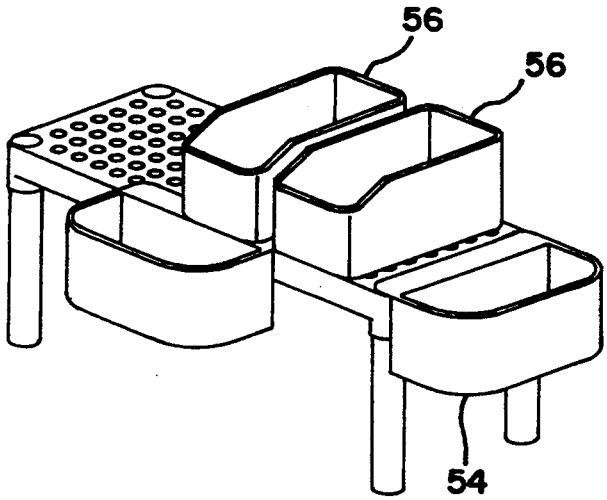

It is apparent that other accessories can also be utilized in conjunction with the assembly incorporated in the present invention. Article receiving containers 56, for example, can be placed on each of the shelf surfaces and have projections insertable into the decorative apertures formed therein to create and organize an arrangement or parts container such as shown in FIG. 9.

Thus there has been disclosed a modular assembly capable of a variety of arrangements while utilizing only three components, namely, a shelf member or unit which can act as a storage shelf or work surface, a plurality of legs or stanchions receivable at spaced locations in the shelf member and typically insertable into sockets formed at equally spaced locations, and a cap member insertable into the unused sockets for providing a decorative appearance and smooth surface.

An assembly incorporating the present invention is capable of assuming a wide variety of configurations and is not limited to connection only at the corners thereof. By utilizing stanchions or legs of varying lengths, a wide variety arrangements and differing appearance can be created with a minimum number of components.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the appended claims.

What is claimed is:

1. A modular assembly comprising:

a first shelf member defining a first generally planar surface;

a plurality of leg members engageable with and supporting said shelf member;

said shelf member being configured at each of a plurality of discrete locations to interact with and retain said leg members in engagement therewith;

each of said locations being equally spaced from the closest immediately adjacent locations, at least some of said locations being at the corners of said shelf member and with at least one additional location being disposed intermediate a pair of said corner locations, said shelf member being engageable with said leg members at selected ones of said locations from both sides thereof to retain said leg members in place and interconnect a plurality of said shelf members in a stacked arrangement with said leg members engaging a pair of said shelf members at any two of said closest immediately adjacent locations in one of said members disposed above any two of said closest immediately adjacent locations in a second of said members for permitting various configurations of stacked arrangements in which said shelf members are not stacked in alignment one above the other.

2. An assembly as claimed in claim 1 wherein each of said locations defines a socket extending through said shelf member from the top to the bottom thereof for receiving an end of a leg member inserted therein.

3. An assembly as claimed in claim 2 wherein each said socket defines top and bottom recesses separated by a stop member located intermediate the ends of said socket.

4. An assembly as claimed in claim 3 wherein each said socket selectively receives an end of a leg member inserted into said top recess with the end of said leg member engageable with said stop member to prevent passage of said leg member completely through said socket.

5. An assembly as claimed in claim 3 wherein each said socket selectively receives an end of a leg member inserted into said bottom recess with the end of said leg member engageable with said stop member to prevent passage of said leg member completely through said socket.

6. An assembly as claimed in claim 1 wherein at each of said locations defines a socket for receiving a leg member inserted therein; and including a cap member insertable into the top of said socket and engageable with a stop member formed therein, the upper surface of said cap member being flush with the surface of said shelf member.

7. An assembly as claimed in claim 6 wherein said socket extends through said shelf member, said cap member being ejectable from said socket by application of force from the bottom thereof.

8. An assembly as claimed in claim 1 wherein said shelf member is generally rectangular and includes at each of said locations a socket extending transverse to the plane of said surface, there being at least one socket at each corner of said shelf member, and at least one additional socket disposed intermediate said corner sockets on at least one pair of opposed sides of said generally rectangular shelf member, each of said sockets defining top and bottom recesses separated by a stop member disposed within each said socket intermediate the ends thereof, a leg member being insertable into the bottom recesses of selected ones of said sockets with an end of said leg member engaging said stop member for supporting said shelf member on said leg members, and additional leg members insertable into the top recesses of selected ones of said sockets to interconnect a plurality of said shelf members in a selected arrangement with said leg members inserted into any pair of said closest immediately adjacent ones of said sockets being insertable into any pair of said closest immediately adjacent apertures in another like shelf member.

9. An assembly as claimed in claim 8 wherein said additional sockets and said corner sockets are equally spaced from the closest immediately adjacent sockets.

10. An assembly as claimed in claim 9 wherein each of said additional socket disposed intermediate said corner sockets on each side of said generally rectangular shelf member is equally spaced from the immediately adjacent sockets disposed on said side.

11. An assembly as claimed in claim 1 including:

a plurality of said additional locations disposed intermediate a pair of said corner locations along at least one side of said shelf member, said plurality of said additional locations along said one side comprising said closest immediately adjacent locations with respect to each other to permit interconnection of a plurality of said shelf members in a stacked arrangement in which said leg members engage at least one of said shelf members at two of said plurality of additional locations to orient one of said shelf members transverse to another.

12. A modular assembly comprised of a shelf member defining an upper surface, said shelf member including a plurality of sockets formed therein at spaced locations along the peripheral edge thereof, at least some of said locations being at the corners of said shelf member and additional locations being disposed intermediate said corner locations, each of said sockets being equally spaced from each of the closest adjacent sockets;

a stop member formed in each of said sockets intermediate the ends thereof to form top and bottom recesses therein;

a plurality of legs insertable into said bottom recesses of said sockets to support said shelf member on said legs, said top recesses of said sockets adapted to receive additional leg members inserted therein for supporting additional like shelf members connected to said additional leg members in a selected arrangement of components wherein each pair of leg members inserted into two of the closest adjacent apertures of one such shelf member can be inserted into any pair of said closest adjacent sockets in another like shelf member for permitting various configurations of stacked arrangements in which said shelf members are not stacked in alignment one above the other.

13. An assembly as claimed in claim 12 wherein each pair of leg members inserted into a pair of the closest adjacent sockets of one such shelf member and inserted into any pair of said closest adjacent sockets in another like shelf member are all inserted into additional sockets intermediate sockets located at said corners.

* * * * *